US007364493B1

(12) United States Patent
Strafford et al.

(10) Patent No.: US 7,364,493 B1
(45) Date of Patent: Apr. 29, 2008

(54) LAP GRINDING AND POLISHING MACHINE

(75) Inventors: David N. Strafford, Pittsford, NY (US); Brian M. Charles, Rochester, NY (US); Timothy S. Lewis, Rochester, NY (US); William C. Lebbon, Rochester, NY (US); James M. Warner, Rochester, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 11 days.

(21) Appl. No.: 11/482,151

(22) Filed: Jul. 6, 2006

(51) Int. Cl.
*B24B 5/00* (2006.01)
*B24B 29/00* (2006.01)
*B24D 17/00* (2006.01)

(52) U.S. Cl. ..... 451/5; 451/495; 451/285; 451/287; 451/288

(58) Field of Classification Search ..... 451/5, 451/8, 11, 285–290, 313–318, 495, 526–539; 29/603.12, 737
See application file for complete search history.

(56) References Cited

U.S. PATENT DOCUMENTS

| | | | | |
|---|---|---|---|---|
| 3,564,776 | A | 2/1971 | Aspden | |
| 3,710,517 | A | 1/1973 | Valerio et al. | |
| 3,735,036 | A | 5/1973 | Macovski | |
| 3,762,207 | A | 10/1973 | Weiser | |
| 4,035,065 | A | 7/1977 | Fletcher et al. | |
| 4,059,346 | A | 11/1977 | Levine et al. | |
| 4,066,343 | A * | 1/1978 | Scott | 359/849 |
| 4,196,961 | A | 4/1980 | Walter et al. | |
| 4,226,507 | A * | 10/1980 | Fuschetto | 359/849 |
| 4,243,301 | A | 1/1981 | Powell | |
| 4,343,116 | A | 8/1982 | Murphy et al. | |
| 4,364,763 | A | 12/1982 | Rennerfelt | |
| 4,678,292 | A | 7/1987 | Miyatani et al. | |
| 4,902,102 | A | 2/1990 | Breidenthal | |
| 4,932,768 | A | 6/1990 | Gobeli | |
| 5,089,915 | A | 2/1992 | Gobeli | |
| 5,208,704 | A | 5/1993 | Zito | |

(Continued)

FOREIGN PATENT DOCUMENTS

| | | |
|---|---|---|
| EP | 0 162 285 | 11/1985 |

(Continued)

OTHER PUBLICATIONS

Practical design and performance of the stressed-lap polishing tool; By S.C. West et al.; Applied Optics, vol. 33, No. 34 (Dec. 1, 1994), pp. 8094-8100.*

(Continued)

*Primary Examiner*—Joseph J. Hail, III
*Assistant Examiner*—Bryan R. Muller
(74) *Attorney, Agent, or Firm*—RatnerPrestia

(57) ABSTRACT

An apparatus, system and method for grinding or polishing an optic is provided. The apparatus includes a shell adapted to a bending profile, torque actuators attached at an outer edge of the shell and coupled to each other, a tensioning system attached at the outer edge of the shell, and a control system for computing the bending profile and controlling the torque actuators and tensioning system. The torque actuators and tensioning system apply bending moments to the edge of the shell to adapt the shell according to the bending profile provided by the control system. A calibration system further corrects errors in a measured bending profile.

11 Claims, 13 Drawing Sheets

U.S. PATENT DOCUMENTS

| | | | |
|---|---|---|---|
| 5,245,402 | A | 9/1993 | Adachi |
| 5,411,617 | A | 5/1995 | La Fiandra |
| 5,462,475 | A | 10/1995 | Kennedy |
| 5,948,468 | A | 9/1999 | Sweatt et al. |
| 6,014,264 | A | 1/2000 | Sommargren |
| 6,206,531 | B1 | 3/2001 | Williams et al. |
| 6,537,138 | B2 | 3/2003 | Ohmori et al. |
| 6,589,102 | B2 | 7/2003 | Wess et al. |
| 6,663,477 | B1 | 12/2003 | Gee |
| 2002/0102925 | A1 | 8/2002 | Wess et al. |

FOREIGN PATENT DOCUMENTS

| | | |
|---|---|---|
| EP | 0 352 709 | 1/1990 |
| EP | 1 048 404 A2 | 11/2000 |
| JP | 02-224963 | 9/1990 |
| JP | 06-179160 | 6/1994 |
| WO | WO 93/01914 | 2/1993 |
| WO | WO 94/29077 | 12/1994 |
| WO | WO 97/00155 | 1/1997 |
| WO | WO 97/14532 | 4/1997 |
| WO | WO 98/12020 | 3/1998 |
| WO | WO 00/00324 | 1/2000 |
| WO | WO 2004/058452 | 7/2004 |

OTHER PUBLICATIONS

Method of Stressed Lap Shape Control for Large Mirror Fabrication; By Yi Zheng et al.; Optomechanical Technologies for Astronomy; Proc. of SPIE vol. 6273, 62730D (Jul. 6, 2006).*

Mechanical Design of the stressed-lap polishing tool; By Wang Lei et al.; Optical Devices and Instruments, vol. 6024, 6024Y (Jan. 25, 2006).*

Practical design and performance of the stressed-lap polishing tool; By S. C. West et al.; Applied Optics, vol. 33, No. 34 (Dec. 1, 1994), pp. 8094-8100.

Progress in the stressed-lap polishing of a.8-m f/1 mirror; H. M. Martin et al.; SPIE, vol. 1236; Advanced Technology Optical Telescopes IV (1990), pp. 682-690.

Overview of Stressed-Lap Polishing Technology; H. M. Martin; Steward Observatory Mirror Lab, University of Arizona (Jan. 4, 2000), pp. 1-4.

* cited by examiner

LAP GRINDING AND POLISHING MACHINE

FIELD OF THE INVENTION

The present invention is related to grinding or polishing an optic, more particularly, a bendable lap for grinding or polishing aspheric optics.

BACKGROUND OF THE INVENTION

The goal of grinding and polishing an optic is to produce a surface of optical quality that meets a set of predetermined specifications typically related to a desired finish and shape. Trends in optical element design continue to move toward larger optics, optics with a lower ratio of focal length to diameter (f#) and optics with increasing asphericity. Optical design may include, for example, spherical optics or aspherical optics with varying amounts of aspheric departure from a best-fit sphere.

The processes of grinding and polishing an optic typically use a relative motion between a lap and the optic. This may be accomplished in a number of ways, frequently involving at least one of controlled relative rotation and translation between the optic and the lap. Either the optic or the lap may be positioned above the other. For example, a table-lap may rotate underneath an optic or an optic may rotate underneath a lap, which may also be rotating and/or translating with respect to the optic. In some cases, symmetry may be used to aid in grinding or polishing the optic because the lap or optic can be rotated around an axis of symmetry. In other cases, as with off-axis aspheres, any symmetry provides minimal if any benefit to the grinding or polishing process. Thus, off-axis aspheres are a class of optics considered to be generally more difficult to manufacture due to the lack of surface symmetry in the optic. When any relative motion exists between a rigid lap and any asphere, a mismatch in shape between the lap and the optic exists and becomes a variable that determines whether a fabrication process is suitable.

Rigid full-aperture laps or petal laps that are passive and maintain a constant shape may be adequate for grinding and polishing piano, spherical, or some aspheric optics. As optics become more aspheric and the optic to lap mismatch exceeds a practical amount, these laps may no longer be adequate. One method to reduce the significance of the optic to lap mismatch is to use smaller laps. Although a small lap will reduce the mismatch error between the lap and optic, other issues may arise. These issues may include an increase in fabrication cycle time, a reduction in localized figure quality, and an adverse edge effect due to the effects of a lap overhanging the edge of an optic. In one specific case, segmented primary mirror designs may be difficult to manufacture due to the increase in the number of edges that an assembly of mirrors contains. Segmented primary mirrors are typically comprised of off-axis aspheric segments. As mirrors tend to have their lowest quality at the edges, this becomes a larger problem when multiple mirrors are assembled to effectively produce one large mirror. Another method to produce aspheric optics is to deform the lap or the optic to accommodate the mismatch during fabrication. This is defined herein as stressed mirror or stressed/active lap processing.

In order to remove high spatial frequency errors a lap is desirably rigid enough to reduce the amplitude of the surface errors from higher forces on the asperities caused by the lap bridging over the surface errors. As the period of the error increases, the lap needs to be increasingly rigid. Given that laps without rigidity may not remove high spatial frequency errors and small laps may cause adverse edge effects as well as a reduced ability to span the errors, it is desired to design a rigid lap that is capable of efficiently removing high spatial frequency errors and improves the edge quality of the optic.

SUMMARY OF THE INVENTION

The present invention is embodied in an apparatus for grinding or polishing an optic. The apparatus includes a shell having known structural parameters and adapted to be bent into desired bending profiles. The shell has a top surface and a bottom surface adapted to be operatively associated with the optic for grinding or polishing the optic. The apparatus further includes a plurality of torque actuators attached to the top surface of the shell at an outer edge. The plurality of torque actuators are further coupled to each other by cables such that the plurality of torque actuators apply bending moments to the edge of the shell. The apparatus further includes a tensioning system attached to the top surface of the shell at the outer edge such that the tensioning system applies further bending moments to the edge of the shell. The apparatus also includes a control system for computing the desired bending profiles using the known structural parameters and controlling each of the torque actuators and the tensioning system according to the desired bending profiles for bending the shell to the desired bending profiles.

The present invention is also embodied in a calibration system used with apparatus for grinding or polishing an optic. The calibration system includes a calibration stand and a plurality of support structures coupled to a surface of the calibration stand. The support structures are adapted to support the apparatus for grinding or polishing the optic. The apparatus has a shell to be bent according to a predetermined bending profile. The calibration system further includes a plurality of displacement gauges projecting from and distributed about the surface of the calibration stand such that the bottom surface of the shell can displace the plurality of displacement gauges as the shell is bent. The calibration system further includes a calibration processor coupled to the plurality of displacement gauges, the plurality of support structures and a control system of the apparatus. The calibration processor measures the bending profile of the apparatus as determined by the plurality of displacement gauges. The calibration processor determines an error between the predetermined bending profile and the measured bending profile and corrects the predetermined profile based on the error.

The present invention is further embodied in a system for grinding or polishing an optic. The system includes a shell having a first surface including at least one actuator to provide a plurality of bending moments to the edge of the shell. The shell has a second surface for grinding or polishing the optic according to a predetermined position. The apparatus also includes an off-loading mechanism for supporting the shell and adjusting a portion of the weight of the shell and a positioning system for adjusting the position of the shell relative to the optic to the predetermined position. The system further includes a control system for controlling and receiving information from the at least one actuator, the off-loading mechanism and the positioning system. The control system computes the predetermined bending profile corresponding to the predetermined position. The control system operates the at least one actuator to provide bending moments to bend the shell into the predetermined bending profile.

The present invention is further embodied in a method for grinding or polishing an optic using a shell capable of being bent. The method includes computing a bending profile for a position of the shell relative to the optic. The method further includes applying a plurality of bending moments to the edge of the shell according to the bending profile for the position and applying a further plurality of bending moments to the edge of the shell with a predetermined force loading according to the bending profile for the position. The shell is bent according to the bending profile for the position.

The present invention is further embodied in an apparatus for grinding or polishing an optic. The apparatus includes a curved strip having known structural parameters and adapted to be bent into desired bending profiles. The curved strip has a top surface and a bottom surface adapted to be operatively associated with the optic for grinding or polishing the optic. The apparatus further includes torque actuators disposed at opposite sides and attached to the top surface of the curved strip at an outer edge. The torque actuators are further coupled to each other by rods. The torque actuators apply bending moments to the edge of the curved strip. The apparatus further includes a control system for computing the desired bending profiles using the known structural parameters and controlling each of the torque actuators according to the desired bending profiles for bending the curved strip to the desired bending profiles.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features may be arbitrarily expanded or reduced for clarity. Included in the drawing are the following figures.

DETAILED DESCRIPTION OF THE INVENTION

The present invention shapes a lap so that optical material can be removed from an optic by the lap according to a desired optic shape. The lap shape is predetermined according to calculations using at least one or a combination of Zernike polynomials to correspond to the desired lap shape. The predetermined lap shape is provided by the application of bending moments to the edge of a lap which cause the lap to be deformed according to the predetermined lap shape. The optic may thus be ground or polished according to the desired optic shape. The present invention allows the lap to be deformed symmetrically or asymmetrically to allow shaping of spherical and aspheric optics. The lap may be shaped to remove optical material over the entire surface of the optic or a portion of optic surface. According to an exemplary embodiment, the lap has a size similar to the optic and is capable of being deformed while having sufficient rigidity to grind or polish the optic to the predetermined lap shape.

Figure 1:
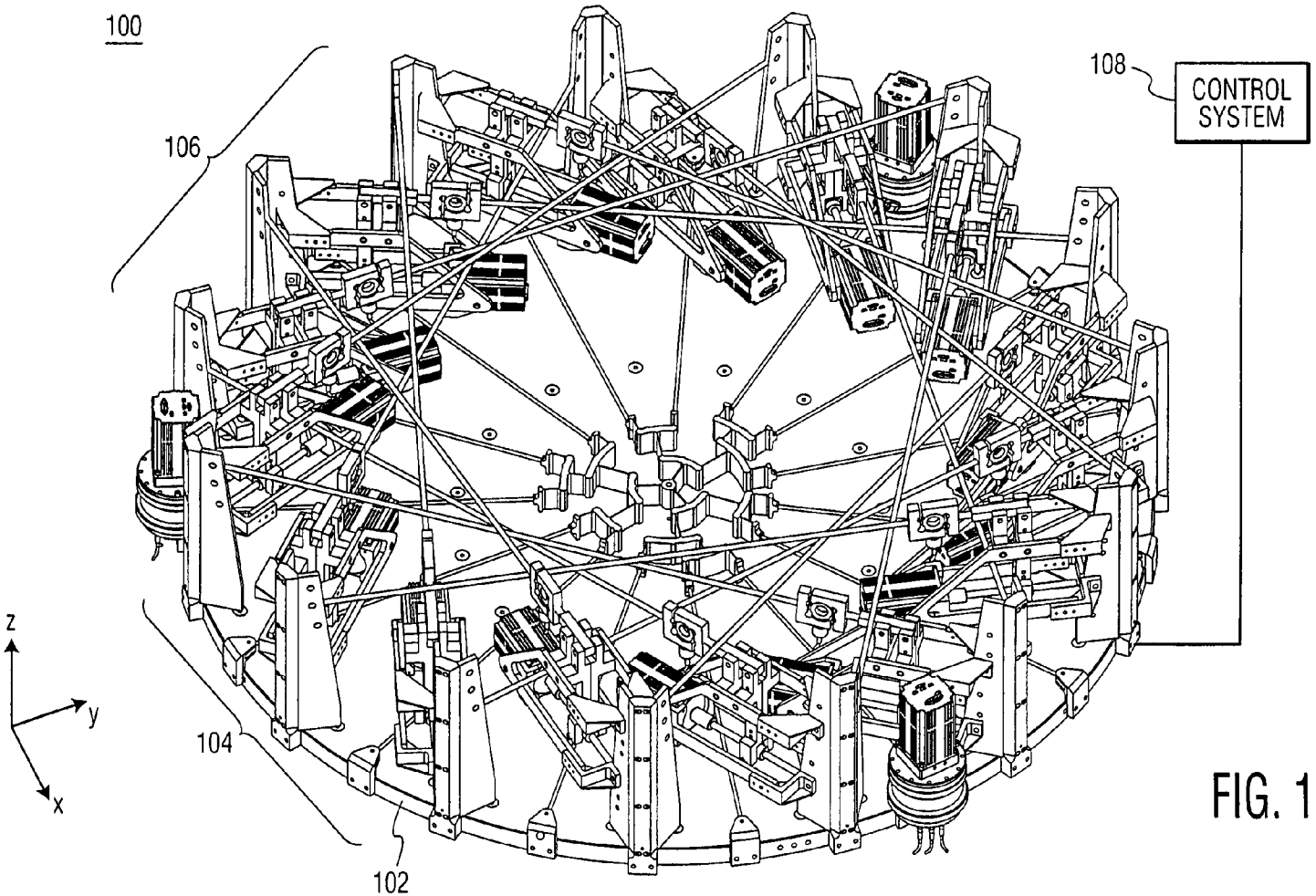
FIG. 1 is a perspective view of an exemplary lap apparatus according to the present invention.

Referring now to FIG. 1, in which like numbers refer to like objects, an exemplary lap apparatus 100 is shown. Lap apparatus 100 includes a shell 102, a tensioning system 104 attached to the edge of shell 102, a torque array system 106 also attached to the edge of shell 102 and a control system 108. Control system 108 is connected to the tensioning system 104 and the torque array system 106. For purposes of clarity, in FIG. 1, the control system 108 is shown connected to only one element of each of tensioning system 104 and torque array system 106.

Shell 102 may be a curved shell with a convex side positioned to apply a material to an optic (not shown) for grinding or polishing the optic. Tensioning system 104 and torque array system 106 may thus be positioned on a concave side of shell 102. A curved shell may provide for a stiff lap apparatus which may improve a smoothing ability of that apparatus. It is contemplated that shell 102 may have a concave side positioned to apply a material to an optic if the optic is convex. Although shell 102 is illustrated as being circular, it is understood that shell 102 may be of any desired shape having a curved surface.

Although a variety of materials may be selected, the exemplary embodiment of lap apparatus 100 includes a shell 102 made of aluminum. It is understood that shell 102 may be made of any material capable of being bent as required. Shell 102 desirably is capable of being deformed by providing bending moments to the edge of the shell and is sufficiently rigid to maintain its deformed shape while its associated optic is being polished or ground.

Although a wide variety of materials may be selected, the exemplary embodiment includes grinding or polishing material of pitch. It is contemplated that the grinding material may include any material capable of grinding or polishing the optic, such as ceramic tile, a perforated metal sheet, synthetic pitch or nylon embedded with grit.

Shell 102 is desirably of a size such that the surface of shell 102 adjacent to the optic is at least as large as the optic. Lap apparatus 100 is thus a full aperture tool in that the shell covers the optic. Because exemplary lap apparatus 100 is a large tool, it may include an improved ability to smooth high and mid spatial frequency errors. Mid spatial frequencies typically have a periodic length between about 2 cm and 40 cm while high spatial frequencies typically have a periodic length between about 0.1 cm and 2 cm. A tool that is at least as large as a periodic length error may be used to smooth the corresponding periodic length error. For example, in order to effectively smooth 40 cm errors the tool is desirably 40 cm in diameter.

The full aperture lap apparatus may further improve an edge quality of an optic because a smaller percentage of the lap apparatus may be unsupported at any given time as compared to a smaller, sub-aperture, lap apparatus. For example, if both the full-aperture and sub-aperture laps are moved the same distance, the full aperture lap may provide for a larger portion of the lap apparatus to remain on the optic as compared to a sub-aperture lap apparatus. Pressure differentials may thus be reduced at the edge of an optic for the full aperture lap apparatus as compared to a sub-aperture lap apparatus.

Shell 102 desirably has known material properties. For example, properties such as Young's modulus, Poisson's ratio, shell thickness, shell diameter and radius may be determined. The structural properties may be used with Zernike polynomials to provide a bending profile that deforms the shell according to the aspheric mismatch resulting from a part-lap relative motion over a desired aspheric optical shape. As is a known in the art, a Zernike polynomial is a mathematical representation of a surface. Zernike polynomial terms may include, for example, power, coma, astigmatism and trefoil. The predetermined bending profile may correspond to at least one Zernike polynomial, a combination or a subset of Zernike polynomials. The Zernike polynomials provide a measure of deflection for various positions on shell 102. A corresponding force may thus be determined that desirably causes shell 102 to be appropriately deflected.

In an exemplary embodiment, a closed form theoretical solution for computing the bending profile is provided. The closed form solution desirably corrects for differences between a theoretical model of the bending profile and the exemplary mechanical system used to implement the predetermined bending profile. In an alternative embodiment, computer simulation may be used to determine the bending profile of the desired optic shape. The predetermined bending profile is desirably translated into a plurality of bending moments to be applied by the tensioning system 104 and the torque array system 106. As described below, the bending moments may be applied by adjusting a tension within the tensioning system 104 and the torque array system 106.

A plurality of bending profiles may be computed and used for different positions of the optic. Thus, during a first lapping operation a first profile may be utilized and during a subsequent lapping operation to be performed on the same optic, a second bending profile would be computed and used. Each bending profile may be determined by control system 108, and thus lap apparatus 100 may be actively deformed relative to the optic during the grinding or polishing process. Although in an exemplary embodiment, control system 108 predetermines and stores each bending profile, it is understood that the bending profiles may be computed in real-time.

Although control system 108 may include any computer capable of transmitted commands to and receiving information, an exemplary embodiment of lap apparatus 100 includes a programmable logic computer control system that controls and links several programmable logic controllers (PLCs). Control system 108 desirably determines at least one predetermined bending profile and information for providing the corresponding shape of shell 102.

Control system 108 is connected to tensioning system 104 and torque array system 106 to control and receive information from the tensioning system 104 and the torque array system 106. The control system 108 may thus use the received information to provide appropriate parameters to tensioning system 104 and torque array system 106 to shape the shell 102 using the predetermined bending profile.

Figure 2A:
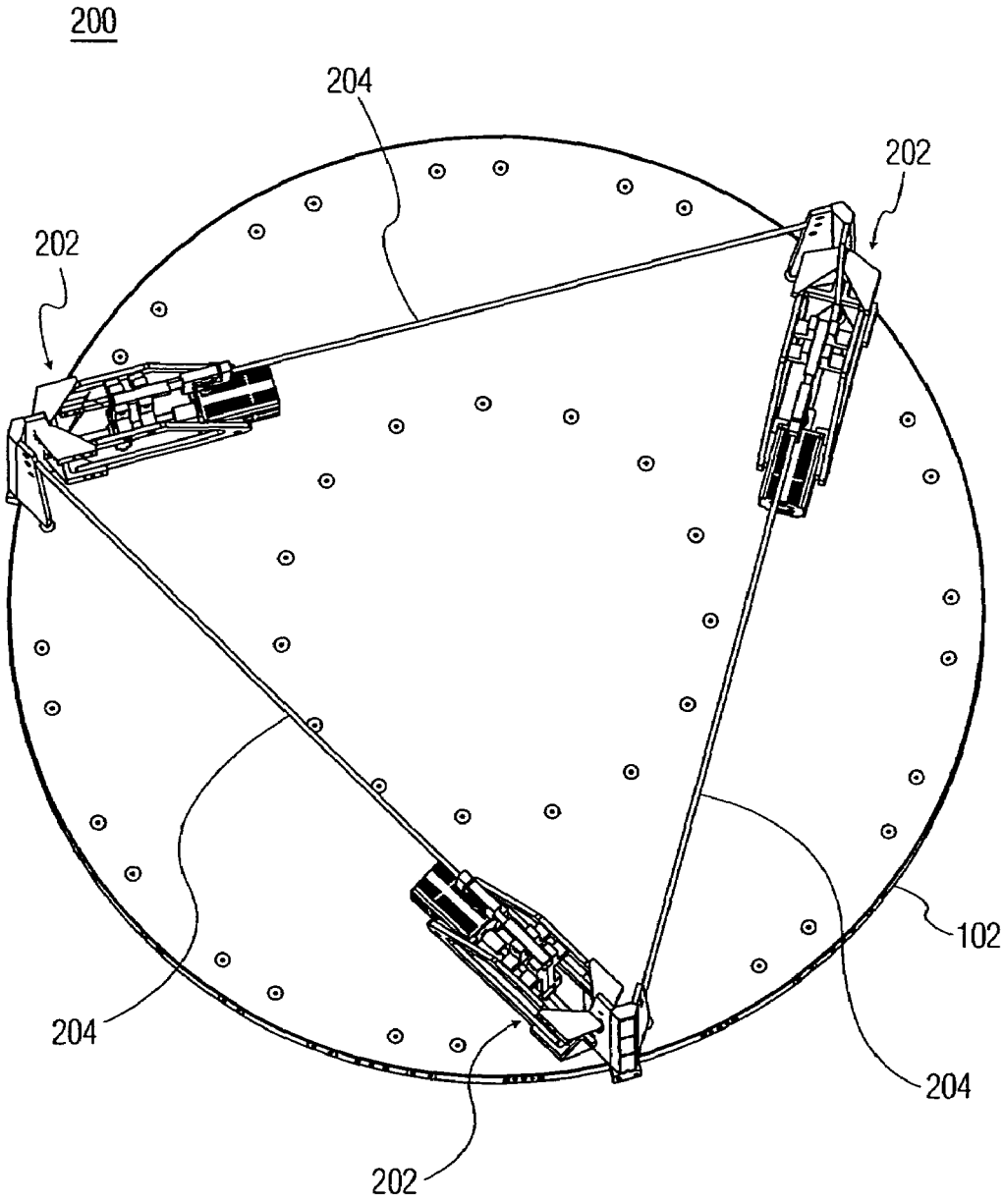
FIG. 2*a* is an overhead perspective view of an exemplary torque actuator array according to the present invention.
Figure 2B:
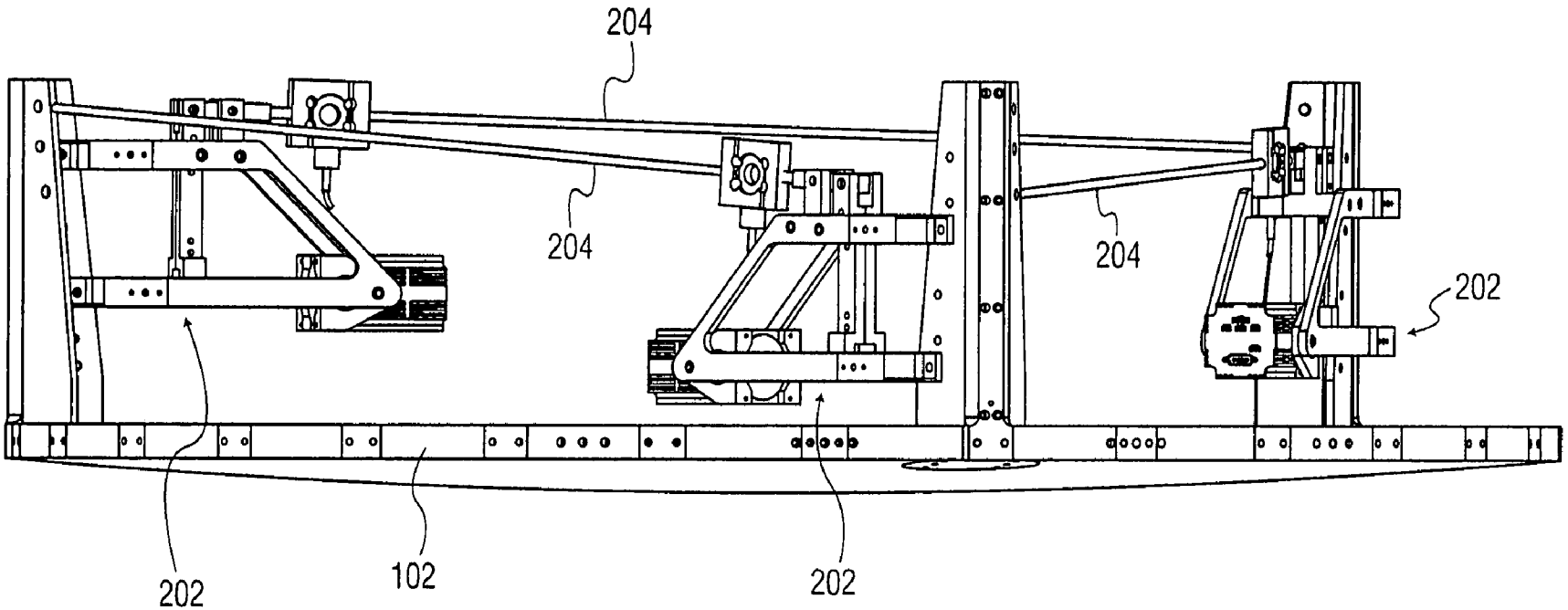
FIG. 2*b* is side perspective view of an exemplary torque actuator array according to the present invention.

FIGS. 2*a* and 2*b* illustrate overhead and side views of an exemplary torque actuator array 200 which is included in torque array systems 106. FIG. 2*a* illustrates a torque actuator array 200 and its relationship to shell 102. Note that each torque actuator is extended to the edge of shell 102 and on its concave surface. Torque array 200 comprises three torque actuators 202. Each torque actuator 202 in an array includes a cable 204 connected to another torque actuator in the array.

Cable 204 may be any cable or rod capable of providing an appropriate tension as determined by the bending profile parameters. It is contemplated that cable 204 may include any mechanical linkage that may transmit a desired force or tension.

Although a torque actuator array 200 is illustrated as defining a triangle, it is understood that an array may include more torque actuators 202 and that the array may be formed of any polygonal shape. In some applications only two torque actuators may be used. Although FIGS. 2*a* and 2*b* illustrate a single array of torque actuators, it is understood that a plural number of arrays may be provided, for example, as illustrated by the torque array system 106 in FIG. 1. Although an exemplary embodiment of the present invention illustrates five arrays each consisting of three actuators, it is understood that any number of arrays 200 may be provided.

Figure 3A:
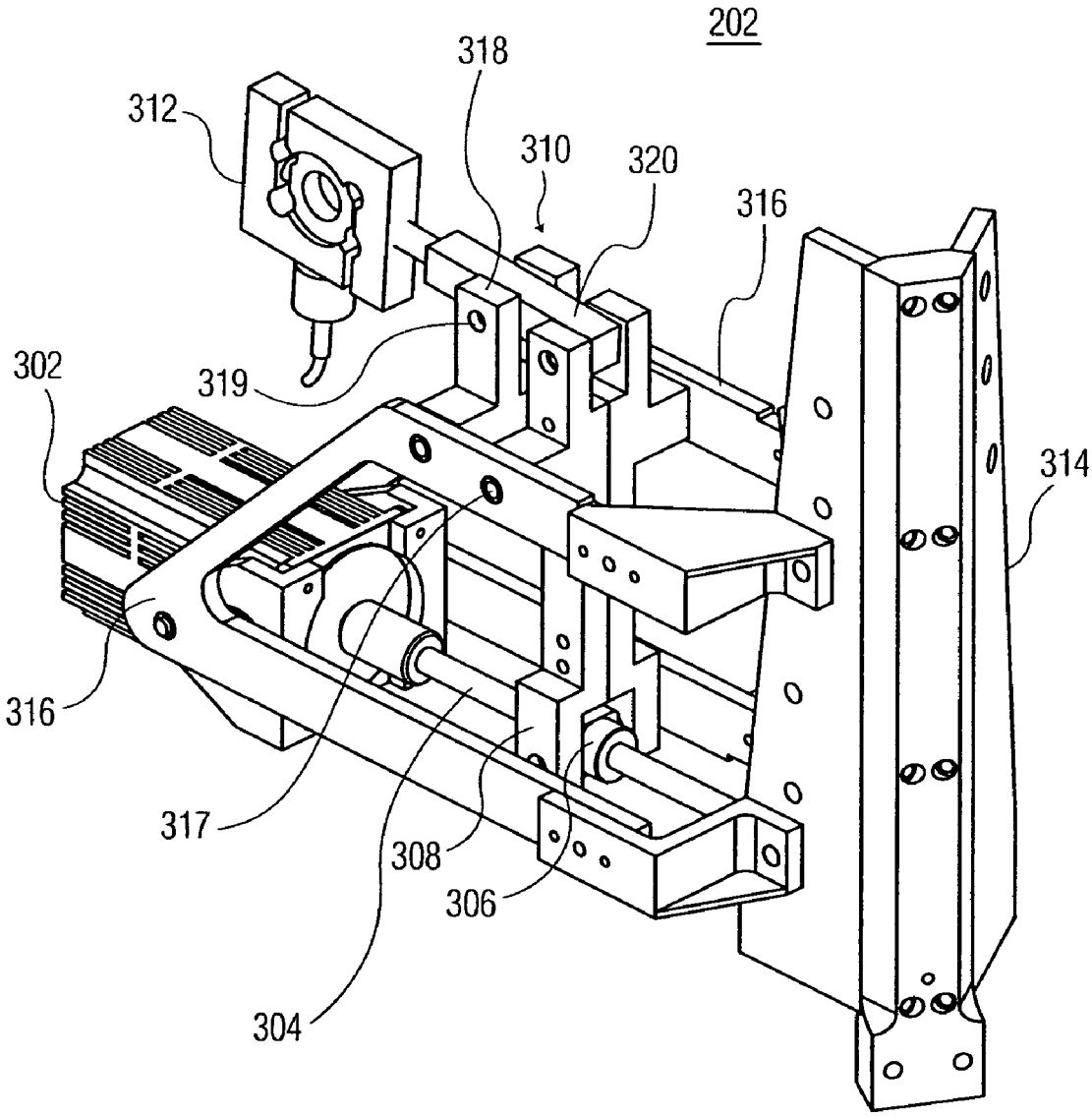
FIG. 3*a* is a side perspective view of an exemplary torque actuator according to the present invention.

Referring now to FIG. 3*a*, an exemplary torque actuator 202 is shown. Torque actuator 202 comprises a motor assembly including a motor 302 that rotates a screw 304 that in turn drives a nut 306. The motor assembly is connected to a four-bar linkage 310 with a lever arm 308. Four-bar linkage 310 is coupled to a load cell 312. Motor 302, screw 304, nut 306, lever arm 308 and four-bar linkage 310 are attached to post 314 with a pair of brackets 316. Cable 204 is coupled to load cell 312 which is driven linearly by four-bar linkage 310. Cable 204 is also attached to a post 314 of another torque actuator 202 in the array. Although an exemplary motor assembly is illustrated having the configuration shown in FIG. 3*a*, it is understood that any motor assembly, such as a liner actuator, server motor or stepper motor may be used to adjust the linkage assembly.

Post 314 desirably allows for positional adjustment of the torque actuator 202 by including multiple locations for attaching the pair of brackets 316 to post 314.

A linkage desirably includes a lever arm 308 one end of which is pivotally carried by the nut 306. The other end of the lever arm 308 is pivotally carried by the brackets 316 by pivot pin 317. Adjacent the other end of the lever arm is another bracket 318 that is also pivotally carried by the brackets 316 by a pivot pin 319. The other end of the lever arm 308 and the bracket 318 pivotally carry a link 320. With this arrangement straight line motion is provided for the link 320 and thus load cell 312. By providing straight line motion, parasitic torques (for example, from friction in the pivot connections) may be eliminated. It is desirable to eliminate parasitic torques because although parasitic torques may bend the shell 102 they may not be sensed by load cell 312.

Figure 3B:
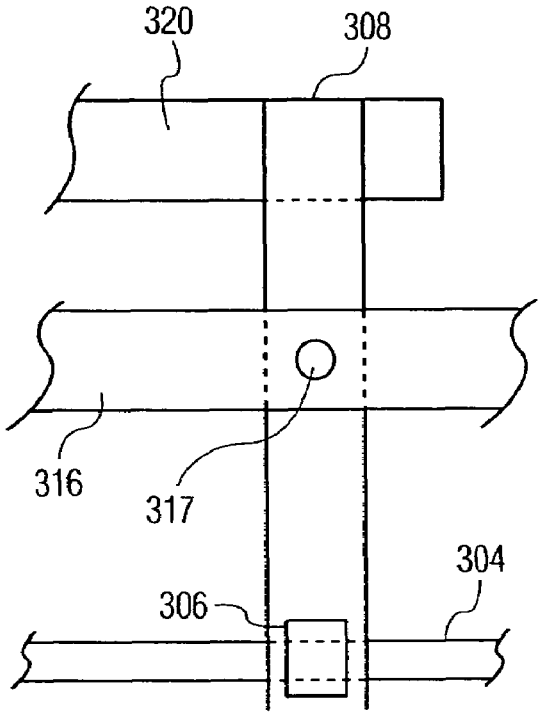
FIG. 3*b* is a partial section view of an exemplary torque actuator illustrating a relationship between a motor assembly and a linkage according to the present invention.
Figure 3C:
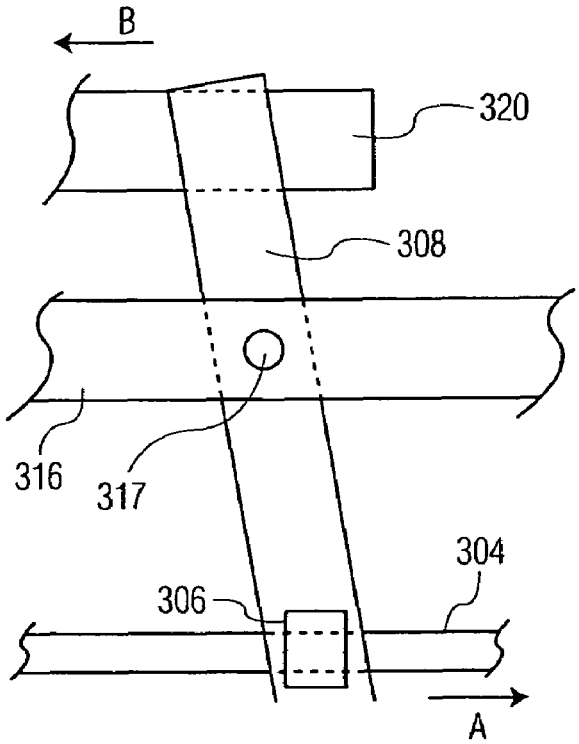
FIG. 3*c* is a partial section view of an exemplary torque actuator illustrating a motion relationship between a motor assembly and a linkage according to the present invention.

FIGS. 3*b* and 3*c* illustrate the action of motor 302, on link 320. Lever arm 308 is also attached to link 320 which work together to adjust the tension in cable 204.

As motor 302 rotates screw 304 to drive nut 306 in the direction indicated by arrow A, nut 306 causes lever arm 308 to pivot and rotate toward the direction indicated by arrow B in FIG. 3C.

The rotation of lever arm 308 in the B direction causes link 320 to move in the B direction. Link 320 is attached to load cell 312 which is coupled to cable 204. The other end of cable 204 is attached to a post 314 of another actuator 202 in the array. Movement of link 320 in the B direction thus reduces the tension on cable 204.

Although not shown, movement of the nut 306 in the opposite direction will cause link 320 to move in a direction opposite direction B and increase the tension of cable 204.

The torque actuator 202 thus adjusts the tension on cable 204 connected to the post 314 of another actuator in this array. Because each actuator is only attached to the edge of the shell, adjusting the tension provides the bending moment to the edge of the shell.

Although exemplary torque actuator 202 is illustrated having the configuration shown in FIG. 3*a*, it is understood that any linkage assembly may be used to adjust the tension in the cable such that bending moments are applied to the edge of shell 102.

The load cell 312 may be any sensor capable of measuring tension in the cable 204 and in the exemplary embodiment it is an S-beam load cell. Load cell 312 is further connected to control system 108 and thus provides tension information to control system 108 (as shown in FIG. 1). Control system 108 may monitor and thus control the applied tension in cable 204 to provide an appropriate bending moment to shell 102 for actuator 202 according to the predetermined bending profile.

Similarly, for each actuator in an array, control system 108 may monitor and control the tension in all cables 204 in the array. Thus the bending moments for the torque array 200 may be provided according to a combination of tensions over the array. It should also be understood that the control system 108 may monitor and control the tension in all cables 204 in each array included in the torque array system 106.

Figure 4A:
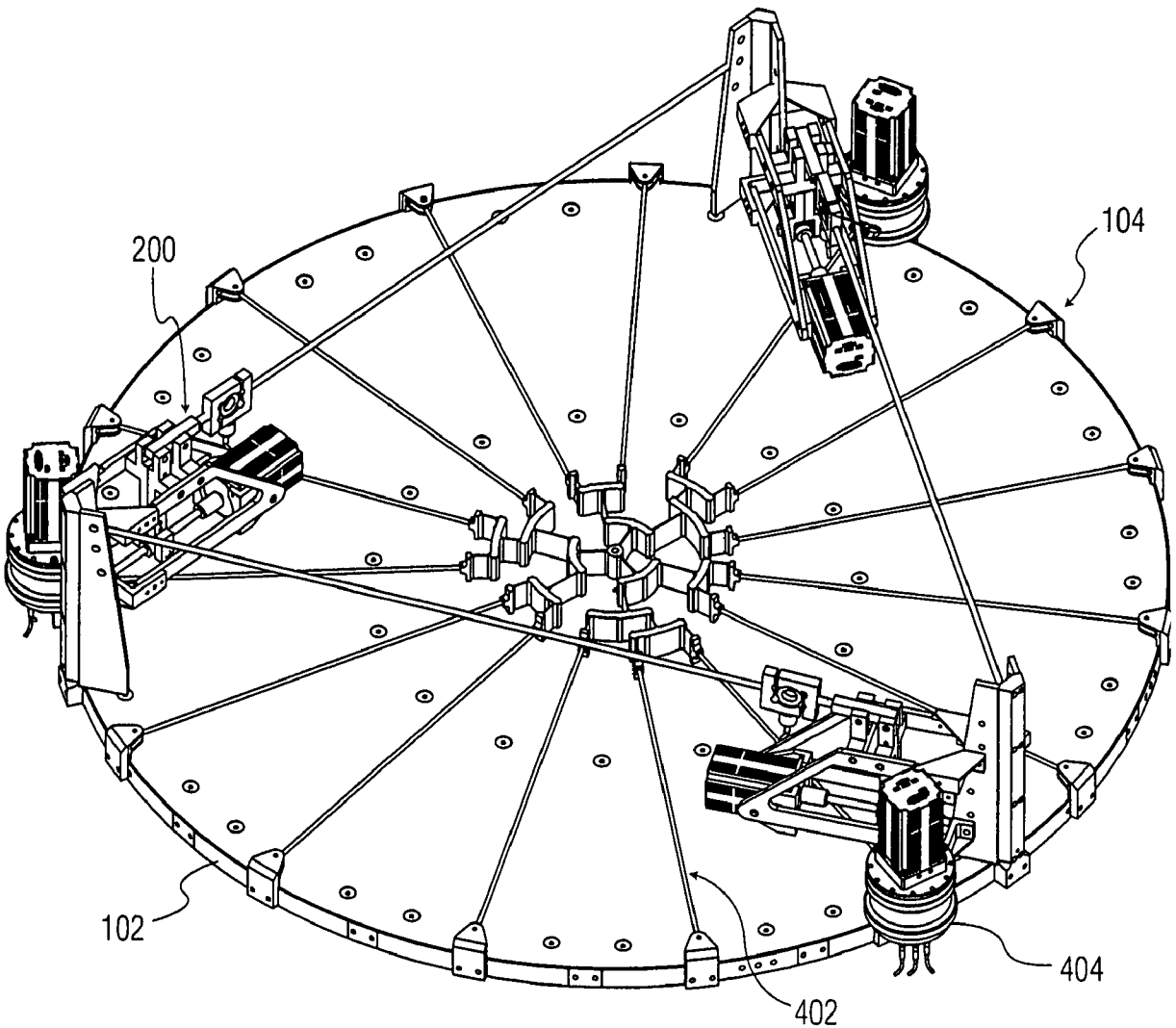
FIG. 4*a* is a perspective view of an exemplary tensioning system and an exemplary torque actuator array according to the present invention.

Referring now to FIG. 4*a*, an exemplary tensioning system 104 and placement on shell 102 relative to a torque actuator array 200 is shown. Tensioning system 104 comprises a whiffletree structure 402 and at least one force actuator 404. Both whiffletree structure 402 and force actuator 404 are attached only to the edge of shell 102. In an exemplary embodiment, the combination of whiffletree structure 402 and force actuator 404 provides a uniform force loading to the edge of the shell. Although an exemplary embodiment provides a uniform force loading, it is contemplated that tensioning system 104 may be configured to provide a non-uniform force loading to the edge of shell 102.

As illustrated in FIG. 4*a*, whiffletree structure 402 is desirably adjacent to shell 102 and below torque actuator array 200. In an exemplary embodiment, the location of whiffletree 402 adjacent to shell 102 and coupling to force actuator 404 allows tensioning system 104 to produce the uniform force loading. Because a lever arm of whiffletree structure 402 is small, whiffletree structure 402 may transmit a small bending moment with a large force. Tensioning system 104 may reduce spherical and power errors. Spherical and power errors are each types of Zernike polynomial. When used alone, torque array system 106 may produce a spherical error and a power error. Similarly, tensioning system 104, may produce a spherical error and a power error when used alone. When tensioning system 104 and torque array system 106 are used in combination, spherical and power errors associated with each of systems 104 and 106 may be developed such that they are substantially cancelled by the combined action of systems 104 and 106.

Figure 4B:
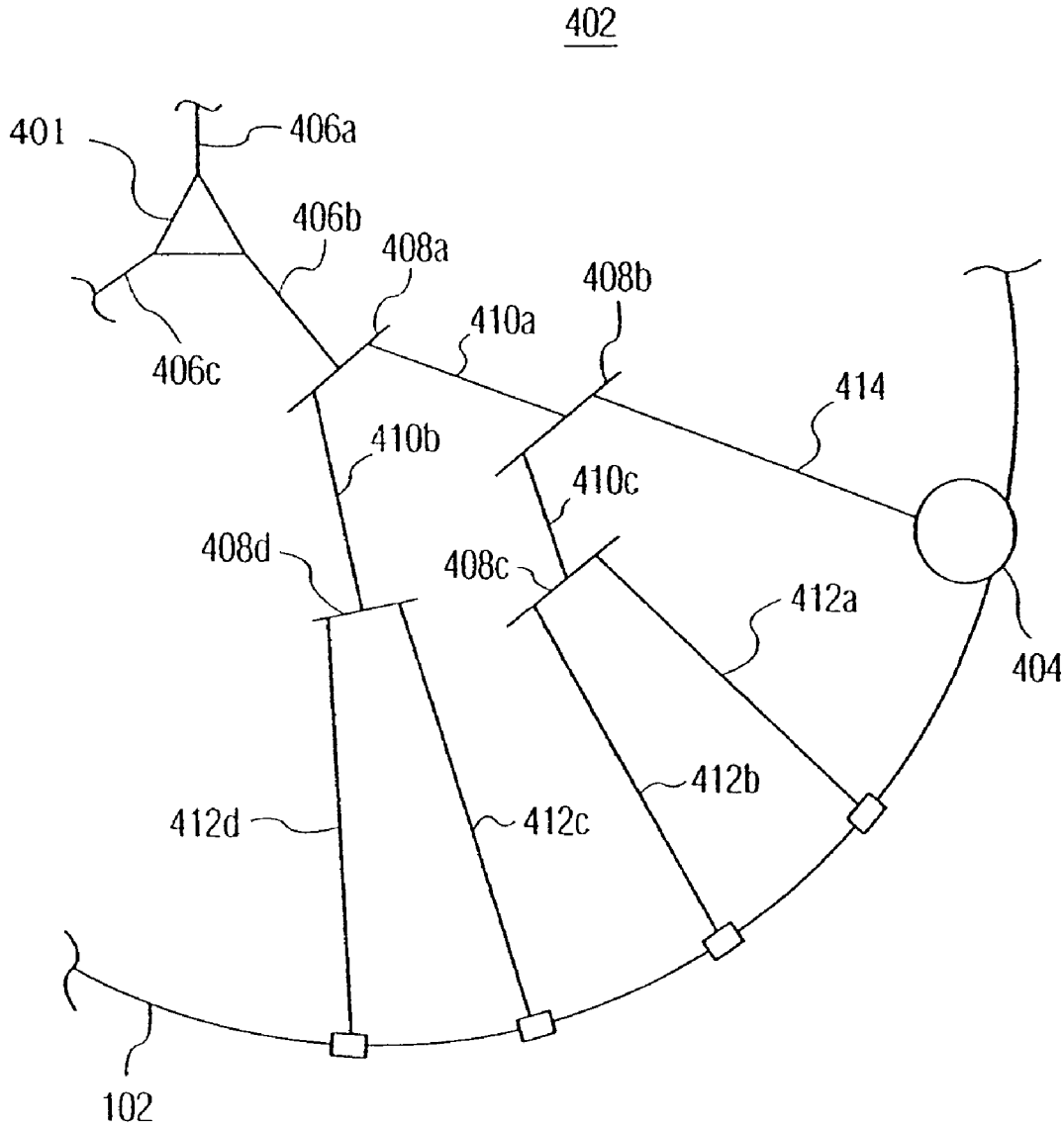
FIG. 4*b* is a partial section view of an exemplary tensioning system according to the present invention.

FIG. 4*b* illustrates a section of exemplary tensioning system 104. Whiffletree 402 desirably includes an apex 401 about a center of whiffletree 402. Three flexures 406*a*, 406*b* and 406*c* are attached to apex 401 and extend to a separate section of whiffletree 402. The section illustrated in FIG. 4*b* includes four beams 408*a-d* and a total of nine flexures including flexure 406*b* connected to apex 404. Apex 401 is connected to beam 408*a* with flexure 406*b*. Beam 408*a* is further connected to beams 408*b* and 408*d* with flexures 410*a* and 410*b*, respectively. Beam 408*b* is connected to beam 408*c* with flexure 410*c*. Beam 408*b* is further connected to actuator 404 with flexure 414. Beam 408*c* is connected to the edge of shell 102 with flexures 412*a* and 412*b*. Beam 408*d* is connected to the edge of shell 102 with flexures 412*c* and 412*d*.

Each beam 408*a-d* desirably includes three flexures connected thereto, thus allowing three forces to act on that beam. In an exemplary embodiment, all of the flexure and beam connection points are rigidly connected to substantially prevent the connections from pivoting. It is desirable to minimize pivot connections to reduce the effects of friction caused by the pivot connections.

According to an exemplary embodiment, whiffletree 402 is fabricated from steel according to a known in the art wire electrical-discharge machining (EDM) process. It is understood that any suitable fabrication process may be used to construct whiffletree 402. It is contemplated that any material having a suitable stiffness for the predetermined bending profile may be used to form whiffletree 402. In an exemplary embodiment, the flexures are rods. It is contemplated that cables or any suitable mechanical linkage may be used. It is desirable that the flexures include a suitable stiffness for efficiently providing a predetermined bending profile by having minimal bending or displacement of the flexure while transmitting the desired force to the edge of the shell.

Although an exemplary embodiment of whiffletree 402 illustrates a beam, for example 408*a*, including three flexures connected thereto, it is understood that each beam may include a different number of flexures connected and that the number of flexures illustrated is not a limited to three. It is understood that any number of beams 408 and flexures 406, 410, 412 and 414 may be used to configure whiffletree 402 such that an adjustable force loading to the edge of the shell 102 is achieved.

In the section illustrated in FIG. 4*b*, flexures 412*a-d* are attached to edge the of shell 102 from respective beams 408*c* and 408*d*. One flexure 414 is attached to force actuator 404 from beam 408*b*. Force actuator 404 is further attached to the edge of shell 102. Flexures 410*a-c* represent flexures connected between respective beams 408*a-d* as shown in FIG. 4*b*. It is contemplated that all connections (e.g. connections between flexures 406, 410, 412 and 414, beams 408 and force actuator 404) may be independently force controlled.

Although FIG. 4*a* illustrates one force actuator 404 coupled to whiffletree 402, an exemplary embodiment further includes three force actuators 404, each one associated with a section of whiffletree 402 illustrated in FIG. 4*b*. Thus an exemplary tensioning system may include three force actuators 404, each one coupled to one flexure 414 of each section of whiffletree 402.

Although three force actuators are illustrated, it is understood that a further number of force actuators may be attached to a respective plurality of flexures. For example, each flexure 412*a-d* extending toward the edge of shell 102 may be coupled to a force actuator. Alternatively, fewer than three force actuators may be provided.

Figure 5A:
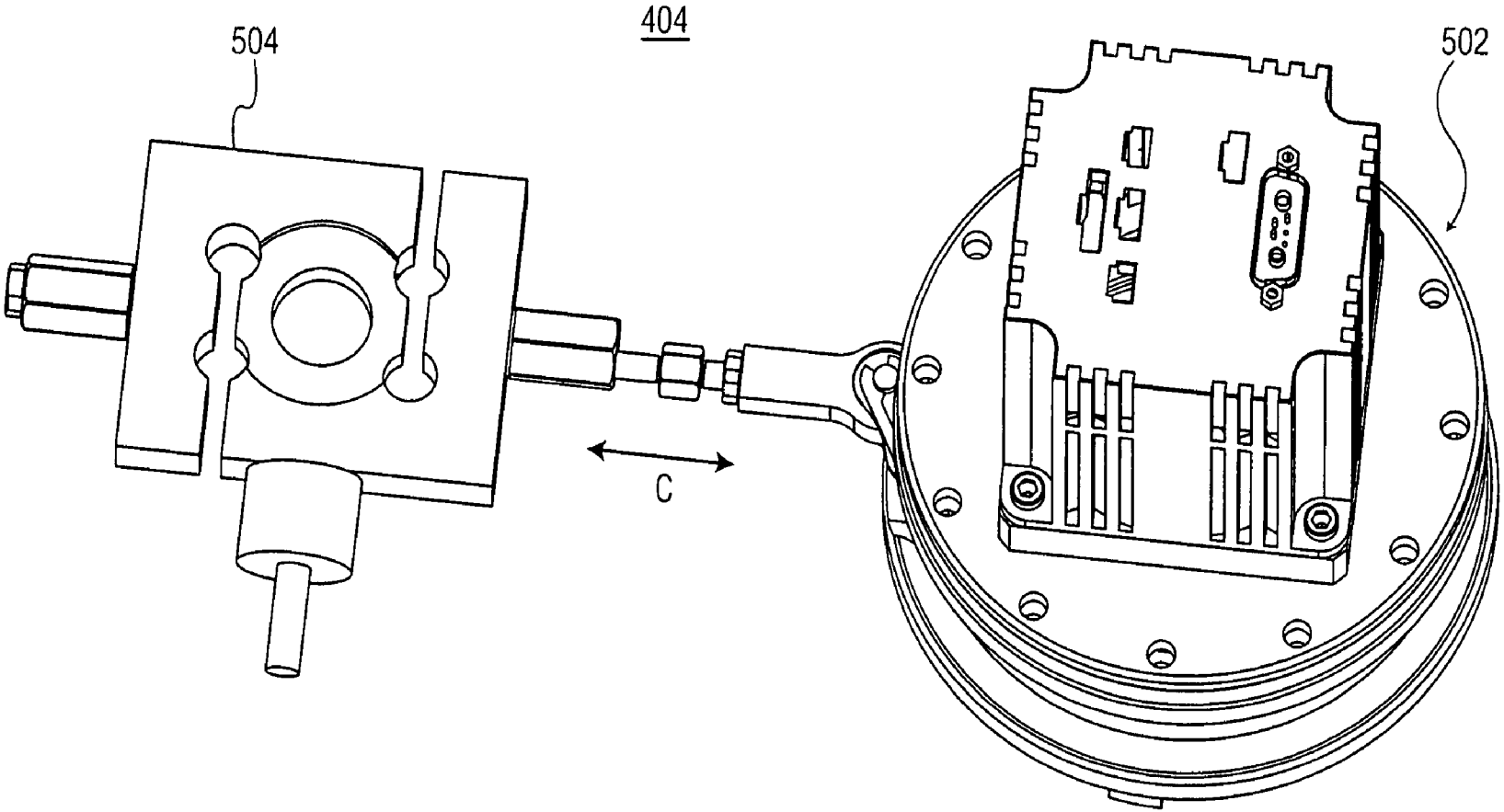
FIG. 5*a* is a perspective view of an exemplary force actuator according to the present invention.

Referring now to FIG. 5*a*, an exemplary force actuator 404 according to an embodiment of the present invention is shown. Force actuator 404 comprises a motor assembly 502 and a load cell 504. Motor assembly 502 is desirably attached to the edge of shell 102. Flexure 414 (not shown) is attached between load cell 504 and motor assembly 502. It is contemplated that load cell 504 may be attached between motor assembly 502 and flexure 414.

Motor assembly 502 is controlled by control system 108 to adjust the tension in flexure 414 (not shown) as illustrated by arrows C. Motor assembly 502 is the same as motor assembly 302 except that the motor assembly is not connected to a lever arm, thus no torque is provided by force actuator 404.

Figure 5B:
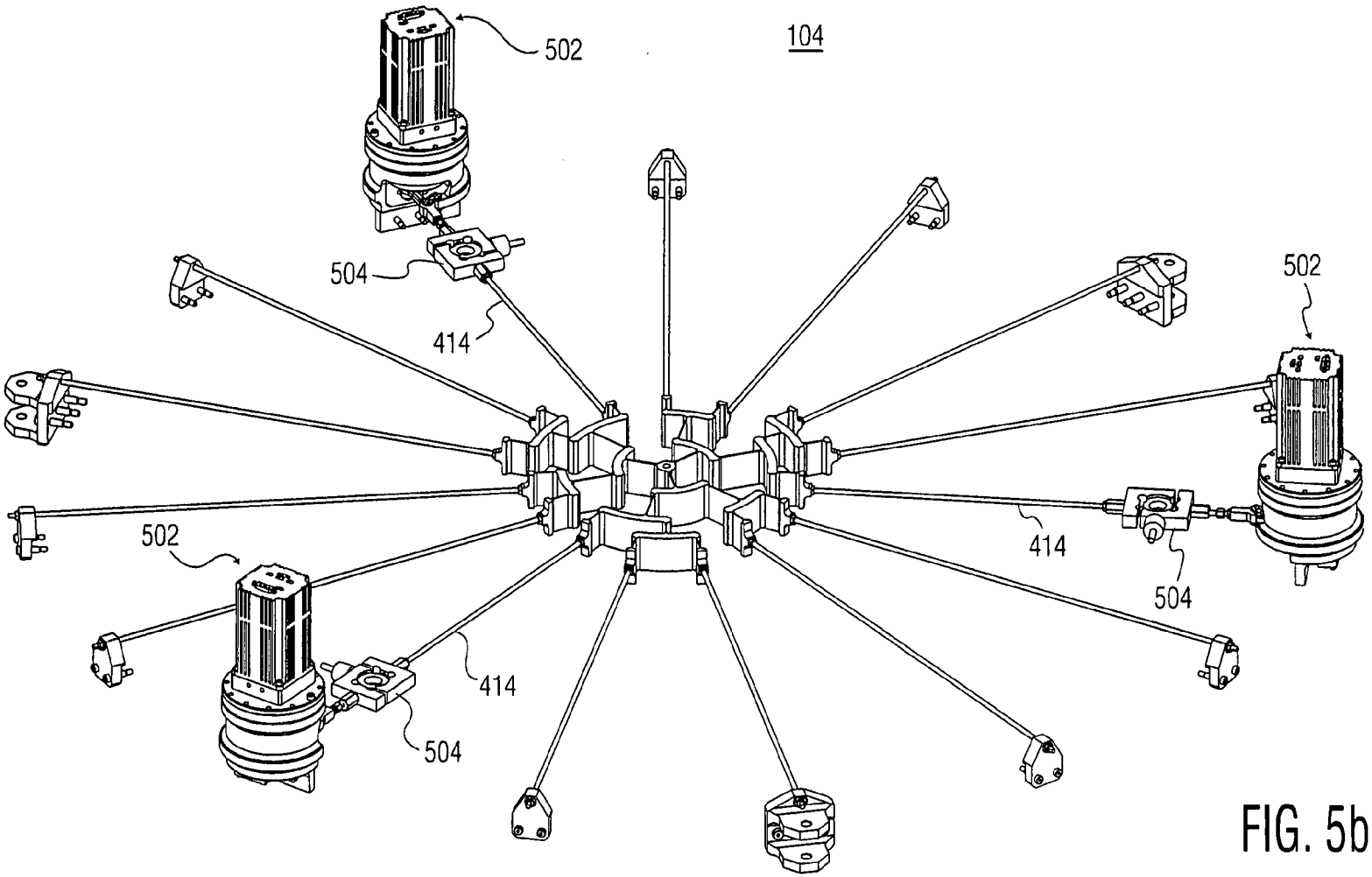
FIG. 5*b* is a perspective view of an exemplary tensioning system illustrating an exemplary force actuator according to the present invention.
Figure 5C:
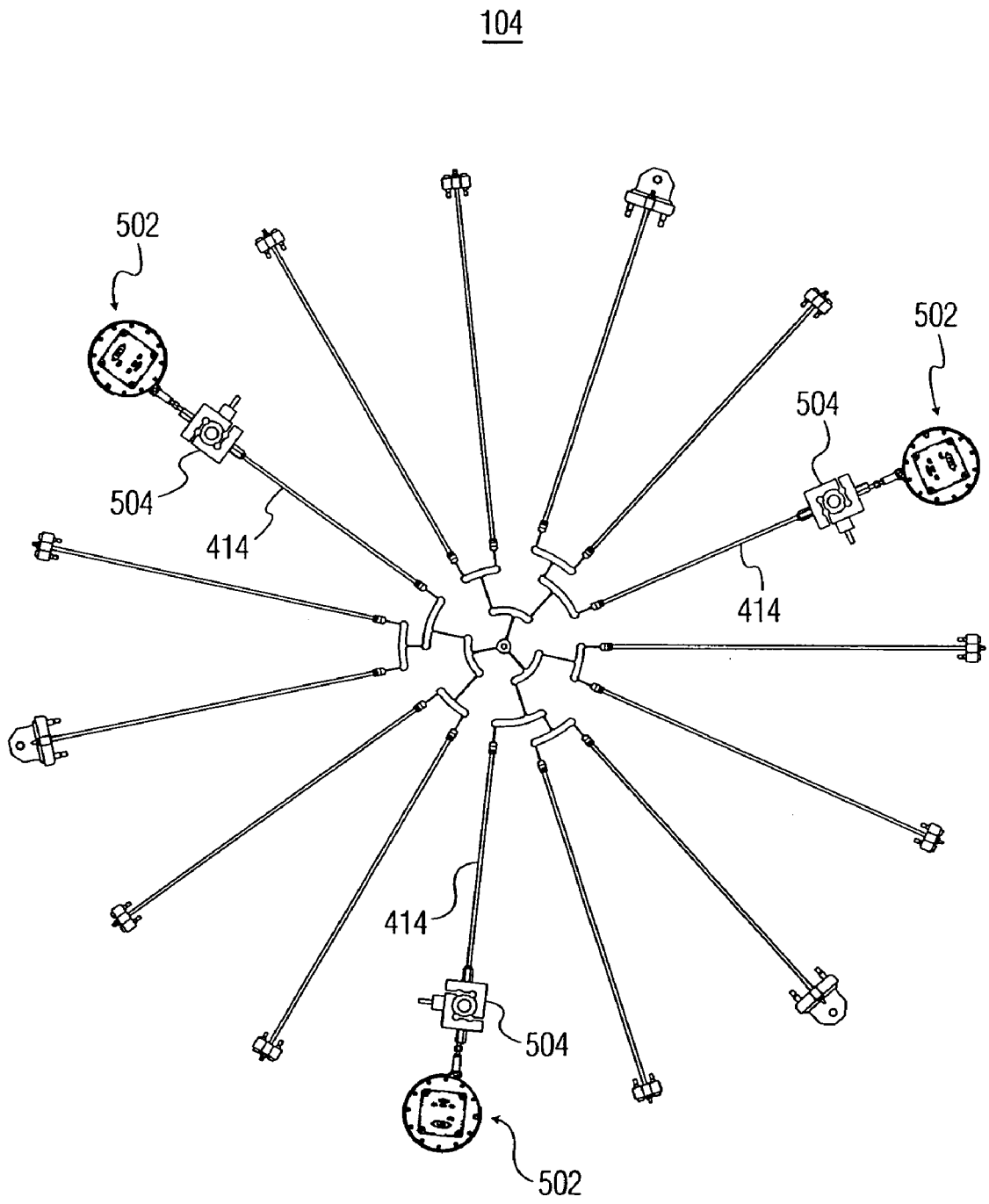
FIG. 5*c* is an overhead view of an exemplary tensioning system illustrating an exemplary force actuator according to the present invention.

Referring now to FIGS. 5*b* and 5*c*, perspective and overhead views of exemplary tensioning system 104 are shown. The position of motor assembly 502 and load cell 504 of force actuator 404 are shown relative to whiffletree structure 402. In an exemplary embodiment, whiffletree 402 includes fifteen connections to shell 102 which may be separated (as shown in FIG. 4*b*) into three equivalent groups of five connections to shell 102. Each group of the exemplary embodiment includes a motor assembly 502 and a load cell 504 to control the applied force to that section of the whiffletree 402. It is contemplated that any suitable whiffletree configuration and any suitable number of force actuators 404 may be used such that an adjustable force loading to the edge of shell 102 is achieved.

The force actuator 404 thus adjusts the tension on its associated flexure 414 and provides equivalent force at each attachment point of a flexure 412*a-d* to the edge of shell 102. Because each actuator and flexure is only attached to the edge of the shell, adjusting the tension provides the bending moment to the edge of the shell.

Load cell 504 is attached to flexure 414 and measures a tension in flexure 414. Load cell 504 is the same as load cell 312 except that the operating range may be different. Load cell 504 is further connected to control system 108 (not shown) and thus provides tension information to control system 108. Control system 108 can monitor and thus control the applied tension to flexure 414 to provide the bending moment to shell 102 for tensioning system 402.

Figure 6:
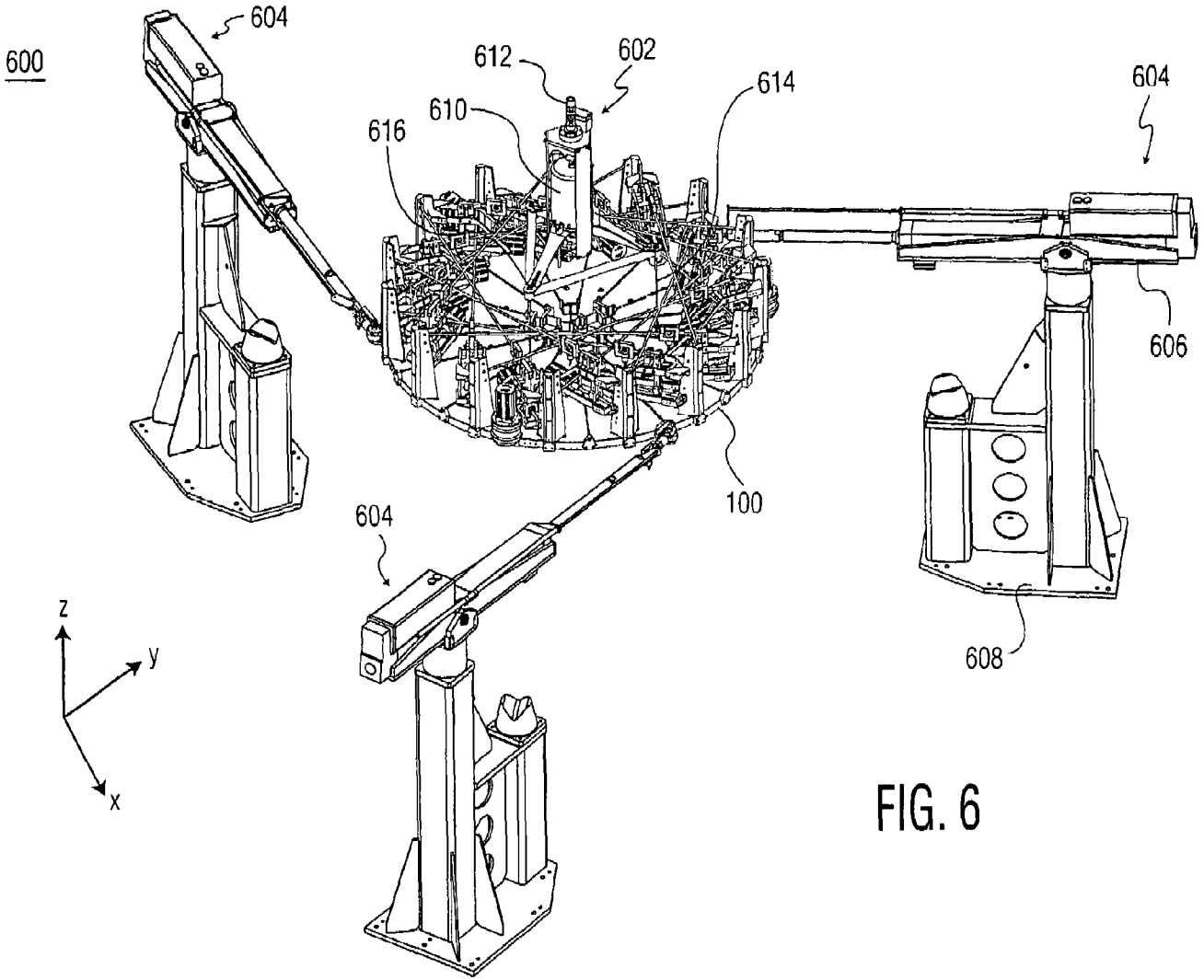
FIG. 6 is a perspective view of an exemplary lap system according to the present invention.

Referring now to FIG. 6, an exemplary lap system 600 is shown. Lap system 600 includes lap apparatus 100 as described above. An off-loading mechanism 602 is coupled with exemplary lap apparatus 100 and supports lap apparatus 100 while the lap apparatus grinds or polishes an optic (not shown). Positioning system 604 is attached to the edge of shell 102 of exemplary lap apparatus 100 and controls the position of lap apparatus 100 with respect to the optic. It is understood that because lap apparatus 100 uses a relative motion between the lap apparatus 100 and an optic in order to grind or polish the optic, positioning system 604 provides continuous positioning of lap apparatus 100 in real-time. Control system 108 (not shown) is connected to lap apparatus 100 as described above and further to off-loading mechanism 602 and positioning system 604 to transmit instructions to and receive information from each of these components as the lap apparatus 100 grinds or polishes an optic. Control system 108 desirably coordinates the positioning of lap apparatus 100 and the bending of lap apparatus 100.

Off-loading mechanism 602 desirably supports lap apparatus 100 on an optic such that a predetermined portion of the weight of lap apparatus 100 determined by control system 108 is transferred to the optic. Off-loading mechanism 602 is connected to lap apparatus 100 using cables 614 and may be further connected to a supporting device such as a crane for positioning the lap apparatus 100 above the optic. In an exemplary embodiment, off-loading mechanism 602 includes a pneumatic air cylinder 610 and load cell 612 connected between air cylinder 610 and the supporting device. Although an exemplary off-loading mechanism 602 uses a pneumatic air cylinder, it is contemplated that a hydraulic system or any other means capable of transferring a predetermined portion of the weight of lap apparatus 100 to the optic may be used. Although an exemplary off-loading mechanism is illustrated as including three cables 614, it is contemplated that a further number of cables 614 may be included, for example, by using a branching member (not shown) to attach more than one cable 614 to a portion of the supporting structure 616.

Load cell 612 desirably monitors the tension between air cylinder 610 and the supporting device and provides the tension information to control system 108. Load cell 612 may be the same as load cell 312 except that the operating range may be different due to the desired weight to be supported. Air cylinder 610 desirably controls the amount of pressure and thus the weight of the lap apparatus transferred to the optic. Air cylinder 610 is desirably controlled by control system 108.

Off-loading mechanism 602 desirably allows for vertical motion to be absorbed by air cylinder 610 as lap apparatus 100 is moved in the X and Y directions. Air cylinder 610 desirably prevents lap apparatus 100 from being displaced in the vertical direction from its contact with the optic. Air cylinder 610 controls a force of the lap apparatus 100 on a curved surface of the optic. As lap apparatus 100 moves up a slope of the curved optic, it pulls the optic up, thus maintaining the force on the optic but allowing for changes in vertical position.

Positioning system 604 may include at least three positioning system structures to position lap apparatus 100 relative to the optic during a finishing process. Each positioning system structure may comprise a linear actuator 606 that is pivot connected to a supporting post 608. Each linear actuator 606 is attached to the edge of shell 102 of lap apparatus 100. Each linear actuator 606 is further connected to control system 108 for controlling the positioning of each linear actuator relative to the optic and providing feedback to the control system 108 regarding their respective positions.

The pivot connection desirably allows the linear actuator freedom to rotate in the Z direction and thus tip the lap apparatus 100. Each positioning system 604 may move in at least one of the x and y direction as well as rotate. By commanding these motions, the position of lap apparatus 100 may be driven along any X and Y path and is not limited to an x-y raster path.

Although an exemplary positioning system 604 is illustrated as including a pivotable linear actuator, it is contemplated that a positioning system may include any components that provide X and Y translation and rotation to position the lap apparatus 100.

Figure 7:
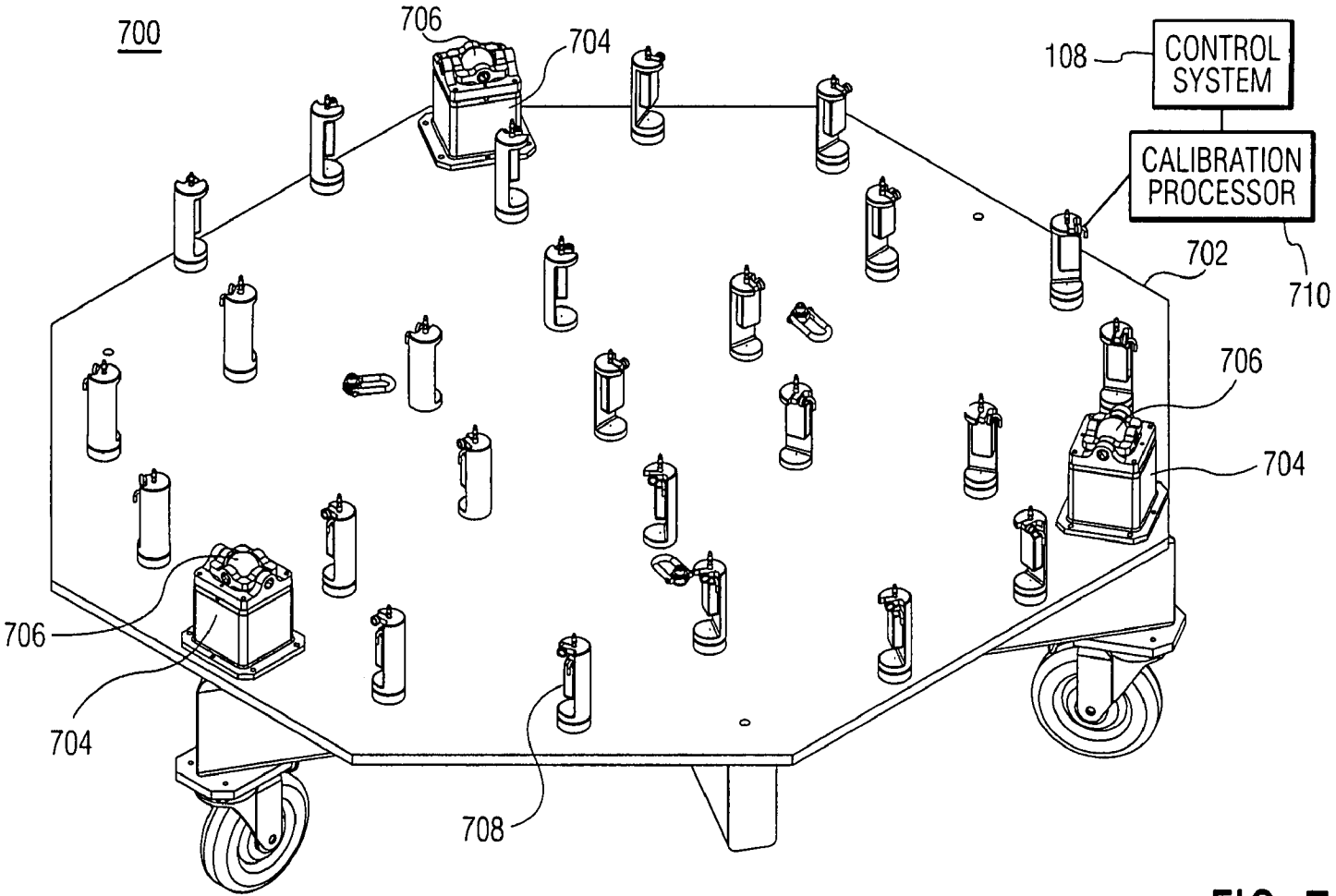
FIG. 7 is a perspective view of an exemplary calibration system according to the present invention and FIG. 8 is a perspective view of an alternate exemplary lap apparatus according to the present invention.

Referring now to FIG. 7, an exemplary calibration system 700 for use with an exemplary lapping system 600 is shown.

Calibration system 700 comprises a calibration stand 702 with a plurality of support structures 704 attached to calibration stand 702. Calibration stand 702 further includes a plurality of displacement gauges 708. The plurality of displacement gauges and their respective positions on calibration stand 702 are connected to calibration processor 710.

Lap apparatus 100 is desirably mounted to calibration stand 702 on supporting structures 704. Offloading mechanism 602 may be used to mount lap apparatus 100 to supporting structures 704 on calibration stand 702. Supporting structures 704 include pivot structures 706 which allow the lap apparatus 100 to produce at least one of rotational and translational motion. In an exemplary embodiment, each pivot structure 706 includes a ball member mounted with cross flexural supports. The cross flexural supports provide the ball member with pivotable motion. Lap apparatus 100 is thus mounted to the ball member of each pivot structure 706. Alternatively, it is contemplated that any mounting system that does not restrict the edge of the shell 102 and therefore does not uncontrollably interfere with any of the bending profiles, such as to add a spurious torque, may be used.

During calibration, calibration processor 710 is connected to control system 108. For purposes of clarity, in FIG. 7, the calibration processor 710 is shown connected to only one displacement gauge 708. Calibration processor 710 may be any computer capable of data acquisition, data analysis, and control of control system 108. A suitable calibration processor 710 will be understood by one of skill in the art from the description herein. Control system 108 provides lap apparatus 100 position information relative to an optic and the measured bending profile. The measured bending profile may be translated to an expected displacement for the displacement gauges.

When the lap apparatus 100 is bent according to the bending profile provided by control system 108 for a position of the lap apparatus relative to an optic, the calibration system measures displacement by the plurality of displacement gauges 708. Because each displacement gauge position is known, an error between expected displacement and measured displacement may be determined and the bending profile calibrated to correct for the error. Calibration system 700 measures the bending profile to determine whether it matches the predetermined bending profile and corrects any errors that it finds by changing the commanded forces so that the actual and desired bending matches. Calibration system 700 may correct the bending profile for a number of lap positions as it will be applied relative to an optic.

Displacement gauge 708 may be any gauge that measures a displacement from a neutral position. Displacement gauges 708 may be linear variable differential transformer (LVDT) transducers or any sensor capable of measuring a displacement such as an optical, capacitive, potentiometric, inductive or eddy current sensor. Displacement gauges 708 may be contact or non-contact sensors, for example a non-contact optical sensor. In an exemplary embodiment, a linear encoder which uses the principle of photoelectric scanning is provided as displacement gauges 708. In an exemplary embodiment, 25 displacement gauges 708 are used to provide bending profile correction. It is contemplated that at least 5 displacement gauges 708 distributed on calibration stand 702 may be used to provide bending profile correction.

The calibration system provides the corrected bending profiles to the control system 108 and the control system 108 desirably stores the corrected bending profiles associated with positions of the lap apparatus 100 relative to the optic. Although in an exemplary embodiment, the corrected bending profiles are stored in control system 108, it is contemplated that a correction factor may be used if the bending profiles are computed in real-time. The corrected bending profile is desirably used when an optic is ground or polished with lap system 600.

Figure 8:
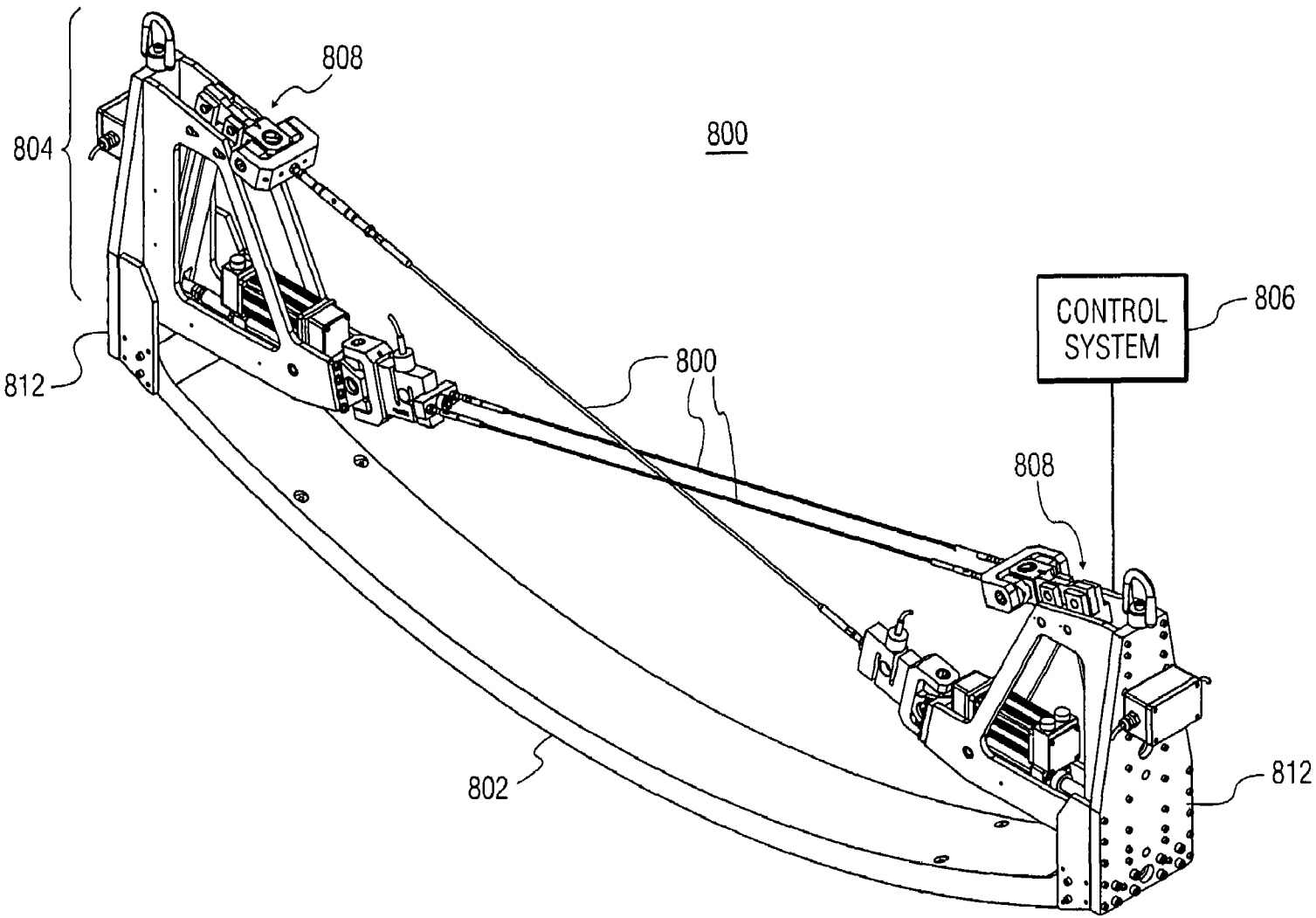

Although an exemplary embodiment illustrates a lap apparatus 100 (FIG. 1) having a curved shell 102, it is contemplated, as described above, that shell 102 may be of any desired shape. FIG. 8 illustrates a perspective view of an alternate exemplary lap apparatus 800. Lap apparatus 800 includes a curved strip 802, a torque array system 804 and a control system 806. Control system 806 is the same as control system 108 (FIG. 1) except that the control system 806 is connected to torque array system 804. For purposes of clarity, control system 806 is shown connected to only one element of torque array system 804. Curved strip 802 may be selected from the same materials as for shell 102 (FIG. 1).

Torque array system 804 includes an array of two torque actuators 808 disposed at opposite sides of curved strip 802. Each torque actuator 808 is extended to the edge of curved strip 802 and on its concave surface. Each torque actuator 808 includes a rod 810 connected to the other actuator 808 in the torque array system.

Each torque actuator 808 is attached to plate 812 that is coupled to the edge of curved strip 802. Rods 810 are also coupled to their respective plates 812, as illustrated in FIG. 8. Rod 810 is the same as cable 204 (FIGS. 2*a-b*) except that a stiffness of rod 810 may be greater than a stiffness of cable 204.

Torque actuator 808 may be the same as torque actuator 202 (FIGS. 2*a-b*). Control system 806 monitors a tension from torque actuators 808 and controls an applied tension in rods 810 according to a predetermined bending profile, as described above.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. An apparatus for grinding or polishing an optic, the apparatus comprising:

a shell adapted to be bent into desired bending profiles, the shell having a top surface and a bottom surface configured for grinding or polishing the optic thereto;

a plurality of torque actuators attached to the top surface of the shell at an outer edge thereto, the plurality of torque actuators further coupled to each other by cables, whereby the plurality of torque actuators apply bending moments to the edge of the shell;

a tensioning system attached to the top surface of the shell at the outer edge thereto, the tensioning system applying further bending moments to the edge of the shell; and a control system for computing the desired bending profiles using the known structural parameters and controlling each of the torque actuators and the tensioning system according to the desired bending profiles for bending the shell to the desired bending profiles;

wherein the tensioning system includes at least one force actuator attached to the edge of the shell; and a plurality of tensioning flexures linked to each other at a location distal from the edge of the shell, at least two tensioning flexures attached to the edge of the shell at spaced locations spaced apart from each other and at least one tensioning flexture attached to the at least one force actuator.

2. The apparatus according to claim 1, wherein the predetermined bending profile bends only a portion of the shell whereby a material is applied to a corresponding portion of the optic for grinding or polishing the optic.

3. The apparatus according to claim 1, wherein the predetermined bending profile bends the entirety of the shell whereby a material is applied to the entirety of the optic for grinding or polishing the optic.

4. The apparatus according to claim 1, wherein the bottom surface of the shell is adapted to grind or polish at least one of a piano, spherical, aspheric, reflective or refractive optic.

5. The apparatus according to claim 4, wherein the aspheric optic is an on-axis asphere or an off-axis asphere.

6. The apparatus according to claim 1, wherein each torque actuator comprises:

a post attached to the edge of the shell;

a linkage coupled to the post and to an end of one of the cables, the other end of the one of the cables coupled to the post of another torque actuator, the linkage adjusting the tension in the cable between the posts; and a motor coupled to the linkage and the control system to adjust the linkage, wherein the tension in the cable between the posts develops the bending moment applied by the torque actuator.

7. The apparatus according to claim 6, the linkage further comprising a load cell for determining the tension applied by its associated torque actuator and for communicating tension information to the control system, the load cell coupled to the end of the one of the cables.

8. The apparatus according to claim 6, including at least two torque actuators, wherein the post of each actuator is connected to a cable associated with an adjacent torque actuator to form a torque actuator array.

9. The apparatus according to claim 8, wherein there are a plural number of torque actuator arrays.

10. The apparatus according to claim 1, wherein the plurality of tensioning flexures comprise a web-shaped whiffletree structure provided adjacent to the top surface of the shell, comprising an apex, a plurality of beams and a plurality of flexures, each of the plurality of flexures being attached to at least one of the apex, the plurality of beams, the edge of the shell and the at least one force actuator, wherein each beam has at least two forces acting on the beam and the at least one force actuator provides a predetermined force loading of the whiffletree structure along the edge of the shell.

11. The apparatus according to claim 10, wherein each of the at least one force actuator comprises:

a motor for adjusting a tension on the flexure attached to the force actuator according to the control system, the motor attached to the edge of the shell; and a load cell for determining a tension applied by the motor and communicating tension information to the control system, the load cell attached between the motor and the flexure attached to the force actuator, wherein the tension in the flexure is distributed throughout the whiffletree structure and provides the further bending moments for the tensioning system.

* * * * *

UNITED STATES PATENT AND TRADEMARK OFFICE

CERTIFICATE OF CORRECTION

PATENT NO. : 7,364,493 B1
APPLICATION NO. : 11/482151
DATED : July 6, 2006
INVENTOR(S) : David N. Strafford et al.

It is certified that error appears in the above-identified patent and that said Letters Patent is hereby corrected as shown below:

Column 1, line 42, of the Letters Patent, please delete “piano” and insert -- plano --.

Column 13, line 17, Claim 4, please delete “piano” and insert -- plano --.

Signed and Sealed this

Twenty-ninth Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,364,493 B1
APPLICATION NO. : 11/482151
DATED : April 29, 2008
INVENTOR(S) : David N. Strafford et al.

It is certified that error appears in the above-identified patent and that said Letters Patent is hereby corrected as shown below:

Column 1, line 42, of the Letters Patent, please delete “piano” and insert -- plano --.

Column 13, line 17, Claim 4, please delete “piano” and insert -- plano --.

This certificate supersedes the Certificate of Correction issued July 29, 2008.

Signed and Sealed this

Twenty-sixth Day of August, 2008

JON W. DUDAS
*Director of the United States Patent and Trademark Office*